US008127482B2

(12) United States Patent
O'Shaughnessy et al.

(10) Patent No.: US 8,127,482 B2
(45) Date of Patent: Mar. 6, 2012

(54) SAFETY SYSTEM FOR FIREARMS

(76) Inventors: Patrick O'Shaughnessy, Knockaderry (IE); Robert Gerard McNamara, Dubai (AE)

( * ) Notice: Subject to any disclaimer, the term of this patent is extended or adjusted under 35 U.S.C. 154(b) by 8 days.

(21) Appl. No.: 12/934,380

(22) PCT Filed: Feb. 5, 2010

(86) PCT No.: PCT/IE2010/000006

§ 371 (c)(1),
(2), (4) Date: Sep. 27, 2010

(87) PCT Pub. No.: WO2010/089730

PCT Pub. Date: Aug. 12, 2010

(65) Prior Publication Data

US 2011/0030262 A1 Feb. 10, 2011

(30) Foreign Application Priority Data

Feb. 5, 2009 (IE) ..... S2009/0099

(51) Int. Cl.
*F41A 17/06* (2006.01)

(52) U.S. Cl. ..... 42/70.11; 42/70.01; 42/70.06

(58) Field of Classification Search ..... 42/70.01–70.11
See application file for complete search history.

(56) References Cited

U.S. PATENT DOCUMENTS 5,461,812 A 10/1995 Bennett
5,603,180 A * 2/1997 Houze ..... 42/70.11
5,867,930 A * 2/1999 Kaminski et al. ..... 42/70.11
5,896,691 A * 4/1999 Kaminski et al. ..... 42/70.11
6,237,271 B1 * 5/2001 Kaminski ..... 42/70.06

(Continued)

FOREIGN PATENT DOCUMENTS

EP 0912871 B1 5/1999

OTHER PUBLICATIONS

International Preliminary Report on Patentability, PCT/IE2010/000006 (Apr. 18, 2011).

(Continued)

*Primary Examiner* — Michael Carone
*Assistant Examiner* — Jonathan C Weber
(74) *Attorney, Agent, or Firm* — Baker Donelson Bearman Caldwell & Berkowitz, PC

(57) ABSTRACT

A firearm enabling and disabling electronic system comprising a base unit (1) and a safety device (4) adapted to be incorporated into a firearm (7). Each of the base unit (1) and the safety device (4) has a transmitter and/or receiver (2, 5) adapted to exchange and process wireless command signals with each other. The safety device (4) has an actuating circuit (6) which is controlled by the transmitter and/or receiver (5) of the safety device (4) and is adapted to actuate a locking mechanism (8), wherein in the locking mechanism is operable to prevent a firearm from firing. The wireless command signal (9) is operable within a predetermined distance between the base unit (1) and the safety device (4) so that when the safety device (4) is located within the predetermined distance from the base unit (1), transmitters and/or receivers (2, 5) exchange the wireless command signal which causes the transmitter and/or receiver (5) of the safety device (4) to prompt the actuating circuit (6) to actuate the locking mechanism (8) thereby causing the locking mechanism (8) to assume a locking mode in which a firearm (7) is prevented from firing.

40 Claims, 2 Drawing Sheets

U.S. PATENT DOCUMENTS

| | | | | |
|---|---|---|---|---|
| 6,363,647 | B2 * | 4/2002 | Kaminski | 42/70.11 |
| 6,412,207 | B1 * | 7/2002 | Crye et al. | 42/70.06 |
| 6,415,542 | B1 * | 7/2002 | Bates et al. | 42/70.11 |
| 6,510,642 | B2 * | 1/2003 | Riener | 42/70.11 |
| 2001/0032405 | A1 * | 10/2001 | Kaminski | 42/70.05 |
| 2002/0032976 | A1 * | 3/2002 | Riener | 42/70.11 |
| 2004/0244253 | A1 | 12/2004 | Glock | |
| 2007/0180749 | A1 | 8/2007 | Shumacher et al. | |
| 2011/0030262 | A1 * | 2/2011 | O'Shaughnessy et al. | 42/70.01 |

OTHER PUBLICATIONS

International Search Report, PCT/IE2010/000006 (May 5, 2010).

Written Opinion of the International Searching Authority, PCT/IE2010/000006 (May 5, 2010).

* cited by examiner

SAFETY SYSTEM FOR FIREARMS

FIELD OF THE INVENTION

The present invention relates to a safety system for a firearm and in particular to an electronic system for enabling/disabling a firearm.

BACKGROUND OF THE INVENTION

Firearms equipped with electronic activation/de-activation devices are known. EP0912871 B1 describes a firearm which has a safety feature which includes an electronically controlled locking mechanism which blocks the firing mechanism of the firearm. The locking mechanism is coupled with a transmitter/receiver unit provided on the firearm. A second transmitter/receiver unit is provided to an authorised user. The transmitter/receiver unit of the firearm wirelessly exchanges coded signals with the authorised user's device so that when the firearm is within a pre-determined distance range from the authorised user and the identification codes of the devices match, the locking mechanism is released. Such a system is useful to prevent the use or misuse of the firearm by any person other than the authorised user, by e.g. a criminal, a child, a mentally disabled person or by anyone else when the firearm is outside the pre-determined distance range from the authorised user who has the transmitter/receiver. The known device, however, cannot prevent the authorised user from accidentally or intentionally firing the weapon in a place or circumstance where firing is prohibited altogether.

The object of the present invention is to provide an improved safety system for a firearm which obviates the above problem.

SUMMARY OF THE INVENTION

Accordingly, the present invention provides a firearm enabling and disabling electronic system comprising

- at least one base unit comprising a transmitter and/or receiver; and
- at least one safety device comprising
- a transmitter and/or receiver adapted to exchange and process wireless command signals with the transmitter and/or receiver of the base unit;
- an actuating circuit controlled by the transmitter and/or receiver of the safety device and adapted to actuate a locking mechanism, the locking mechanism being operable to prevent a firearm from firing;

wherein the wireless command signal is operable within a predetermined distance between the base unit and the safety device; and wherein when the safety device is located within the predetermined distance from the base unit, transmitters and/or receivers of the base unit and of the safety device exchange the wireless command signal which causes the transmitter and/or receiver of the safety device to prompt the actuating circuit to actuate the locking mechanism thereby causing the locking mechanism to assume a locking mode capable of preventing a firearm from firing.

The system of the present invention prevents the use or misuse of a firearm equipped with the safety device within a designated area in which the use of firearms is prohibited, e.g. police stations, schools etc. To enable this, the base unit is disposed within the designated area whereby as soon as a firearm equipped with the safety device is brought into the designated area the locking mechanism is actuated thereby locking the firing mechanism of the firearm. Conversely, as soon the firearm is taken outside the designated area, that is, outside the predetermined distance range, the base unit and the safety device stop exchanging and processing the command signal and the actuating circuit is prompted by the transmitter and/or receiver of the safety device to release the locking mechanism.

Preferably, the predetermined distance range between the base unit and the safety device within which the command signal is operable and within which the transmitter and/or receiver of the base unit and the transmitter and/or receiver of the safety device can exchange and process the command signal is sufficient to cover a designated area in which firearms equipped with the safety device of the system of the invention need to be disabled and is between 0 m and 100 m and preferably between 0 m and 200 m.

The safety device is adapted to be incorporated into a firearm so that the locking mechanism co-operates with the firing mechanism of the firearm.

Ideally, the system of the invention comprises a plurality of safety devices for incorporating into a plurality of firearms. In this case, the same command signal is processable by each safety device. Alternatively, the base unit can be adapted to process a plurality of command signals each command signal being unique to one corresponding safety device.

Ideally, the safety device further comprises a reader device coupled with the actuating circuit of the safety device and a tag device adapted to be worn by a user of a firearm, wherein each of the reader device and the tag device comprises a transmitter-receiver, wherein the reader device and the tag device are adapted to exchange and process wireless authorisation signals within a predetermined distance range from each other, wherein when the safety device is located within the predetermined distance range from the tag device, the reader device and the tag device exchange and process the wireless authorisation signal, whereby the reader device prompts the actuating circuit to release the locking mechanism from the locking mode.

Once the safety device and the tag device are separated by a distance greater than the predetermined distance, the reader device prompts the actuating circuit to actuate the locking mechanism thereby causing the locking mechanism to assume a locking mode capable of preventing a firearm equipped with the safety device from firing. Ideally, the predetermined distance range is between 0 m and 1 m. The above-described feature of the system of the invention further restricts the usability of a firearm when the authorised user is outside the predetermined distance of operability of the command signal of the transmitter and/or receiver of the base unit so that the firearm can be only used by an authorised user, i.e. a wearer of the tag device and within an area in the immediate vicinity of an authorised user wearing the tag device.

Advantageously, in the system of the present invention, the transmitter and/or receiver of the safety device is coupled with the actuating circuit so that it overrides the reader device in controlling the actuating circuit, whereby when the safety device is within the predetermined distance of operability of the command signal, the transmitter and/or receiver of the base unit and the transmitter and/or receiver of the safety device exchange and process the command signal, whereby the transmitter and/or receiver of the safety device prompts the actuating circuit to actuate the locking mechanism thereby causing the locking mechanism to assume the locking mode regardless whether or not the safety device is located within the predetermined distance range from the tag device and the reader device has prompted the actuating circuit to release the locking mechanism. Due to this arrangement, when an authorised wearer of the tag device who carries an enabled firearm equipped with the safety device enters a designated area in which the use of firearms is prohibited, the transmitter and/or receiver of the safety device overrides the command of the reader device and prompts the actuating circuit to actuate the locking mechanism into the locking mode thereby locking the firearm.

The predetermined distance range of operability of the command signal exchanged between the transmitter and/or receiver of the safety device and the base unit is considerably (e.g. tens of times) greater than the predetermined distance range of operability of the authorisation signal exchanged between the reader device and the tag device. More specifically, the predetermined distance range of operability of the command signal is comparable with dimensions of a building (e.g. from about 10 m to about 100 m), whereas the predetermined distance range of operability of the authorisation signal lies within an immediate vicinity of a user wearing the tag device and is preferably between 0 m to 1 m.

Preferably, the wireless communication between the transmitter and/or receiver of the base unit and the transmitter and/or receiver of the safety device is a radio-frequency (RF) communication which is carried out using a local area wireless communication protocol capable of operating within a distance of 0 m to 100 m and preferably within 0 m to 200 m, or within 0 m to 1000 m, the distance being adjustable to a desired smaller distance if required. Ideally, the local area wireless communication protocol is a low-data protocol the use of which renders the wireless connection between the transmitter and/or receiver of the base unit and the transmitter and/or receiver of the safety device a low-power connection. Preferably, the radio-frequency is selected from the ultra-high RF band (300 MHz to 3 GHz).

Preferably, the wireless communication between the transmitter-receiver of the reader device and the transmitter-receiver of the tag device is a radio-frequency (RF) communication which is carried out using a short-range wireless transmission protocol capable of operating within a distance of 0 m to 1 m. Preferably, the radio-frequency is selected from the high RF band (3 MHz to 30 MHz). Ideally, one of the reader device and the tag device is battery operated and the other is a passive device to render the wireless connection between the reader device and the tag device a low-power connection.

The tag device can be incorporated into e.g. ring, bracelet, wristwatch, cuff link etc.

The signals exchanged between the reader device and the tag device and between the transmitter and/or receiver of the base unit and the transmitter and/or receiver of the safety device can be either coded or un-coded. In a preferred arrangement however, the authorisation signals exchanged between the reader device and the tag device are coded so that a firearm equipped with a safety device of the present invention can only be enabled by a matching tag device, or a group of tag devices sharing the same code.

In one preferred arrangement, the locking mechanism is arranged to remain in the locking mode at all times without the need for the actuating circuit to keep it in the locked mode. Ideally, the actuating circuit is only needed to switch the locking mechanism between the locked and the released modes, thereby minimising the power required for manipulating the locking mechanism. In one preferred arrangement, the actuating circuit comprises an electro-mechanical element, such as, for example, a solenoid or an electromagnetic actuator for actuating the locking mechanism. Preferably, once the locking mechanism is in the locked mode, it can only be released by the actuating circuit. In one arrangement, the locking mechanism comprises a pin or a catch member moveable under the influence of the actuating circuit in and out of locking engagement with the firing mechanism of the firearm.

As a further safety feature, one of the tag device or the reader device comprises a manual on/off switch so that the tag and the reader can exchange the authorisation signal within the pre-determined distance range upon actuation of the switch by the authorised user.

DETAILED DESCRIPTION OF PREFERRED EMBODIMENTS

The invention will now be described with reference to the accompanying drawings which show by way of example only a firearm enabling and disabling electronic system according to the invention. In the drawings.

Figure 1:
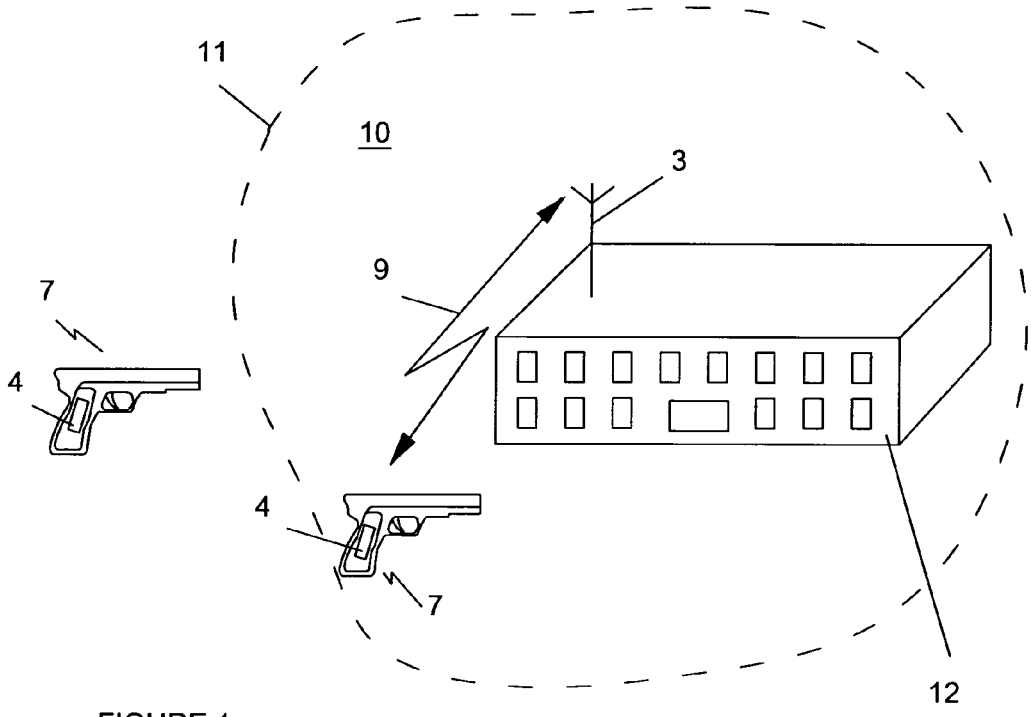
FIG. 1 is a schematic illustration of a system according to the invention.
Figure 2:
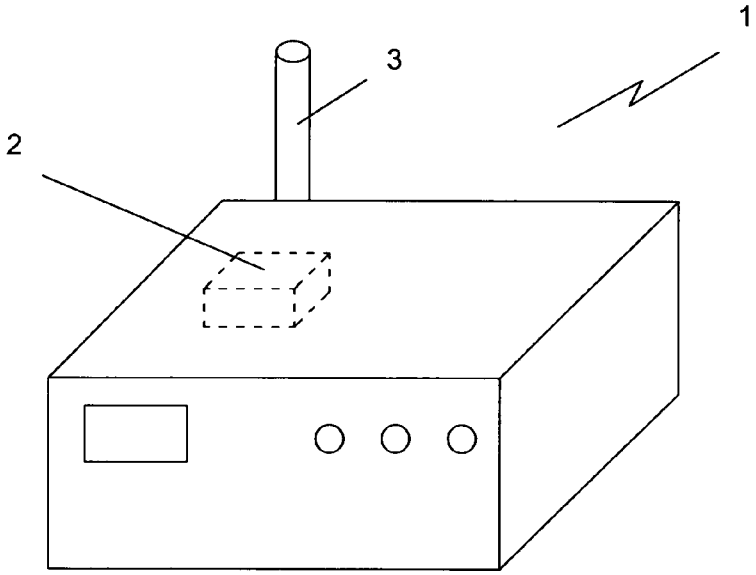
FIG. 2 is a perspective schematic view of a base unit of the system of the invention.
Figure 3:
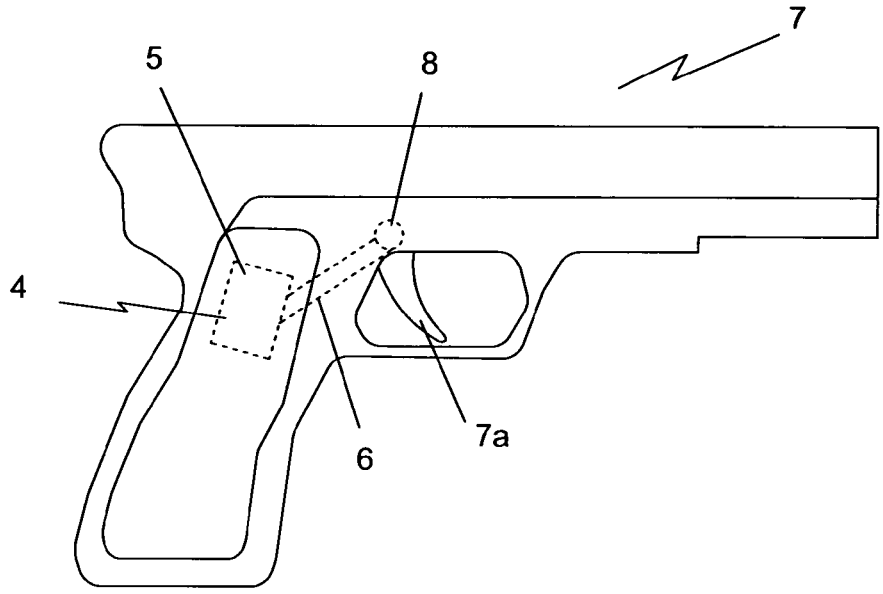
FIG. 3 is a schematic view of a firearm equipped with a safety device according to the invention.

Referring to FIGS. 1 to 3, a firearm enabling and disabling electronic system of the present comprises at least one base unit 1 comprising a transmitter and/or receiver 2 and an antenna 3.

The base unit 1 co-operates with a safety device generally indicated by reference numeral 4 in FIG. 3. The safety device 4 is shown built-into a firearm 7 and includes a transmitter and/or receiver 5 adapted to exchange and process wireless command signals 9 with the transmitter and/or receiver 2 of the base unit 1. The safety device 4 further includes an actuating circuit 6 controlled by the transmitter and/or receiver 5 of the safety device 4. The actuating circuit 6 is adapted to actuate a locking mechanism 8 which is adapted to lock and unlock the trigger 7*a* of the firearm 7 in order to, respectively, disable or enable the firearm 7.

The wireless command signal 9 is operable within a predetermined distance between the base unit 1 and the safety device 4. Accordingly, when the firearm 7 equipped with the safety device 4 is located within the predetermined distance from the base unit 1, the transmitter and/or receiver (2, 5) of the base unit 1 and of the safety device 4 exchange the wireless command signal 9 which causes the transmitter and/or receiver 5 of the safety device 4 to prompt the actuating circuit 6 to actuate the locking mechanism 8 and cause the locking mechanism 8 to assume a locking mode in which the trigger 7*a* is locked and the firearm 7 is prevented from firing.

The system of the present invention prevents the use or misuse of a firearm 7 equipped with the safety device 4 within a designated area 10 (schematically defined by a dotted line 11 in FIG. 1) in which the use of firearms is prohibited, e.g. police station premises, school premises etc. To enable this, the base unit 1 is disposed within the designated area 10, e.g. inside a building 12. As soon as a firearm 7 equipped with the safety device is brought into the designated area 10, the transmitter and/or receiver (2, 5) of the base unit 1 and of the safety device 4 exchange the wireless command signal 9 and the locking mechanism 8 is actuated thereby locking the firing mechanism of the firearm 7. Conversely, as soon the firearm 7 is taken outside the designated area 10, that is, outside the predetermined distance range, the base unit 1 and the safety deice 4 stop exchanging and processing the command signal 9 and the actuating circuit 6 is prompted by the transmitter and/or receiver of the safety device 4 to unlock the locking mechanism 8.

The predetermined distance range between the base unit 1 and the safety device 4 within which the command signal 9 is operable and within which the transmitter and/or receiver 2 of the base unit 1 and the transmitter and/or receiver 5 of the safety device 4 can exchange and process the command signal 9 is sufficient to cover the designated area 10 in which firearms 7 equipped with the safety device 4 of the system of the invention need to be disabled. The predetermined distance range is preferably between 0 m and 100 m or between 0 m and 200 m.

Where the system of the invention comprises a plurality of safety devices 4 incorporated into a plurality of firearms 7, the same command signal 9 is preferably processable by each safety device 4. Alternatively, the base unit 1 can be adapted to process a plurality of command signals unique to each one of the safety device 4.

Figure 4:
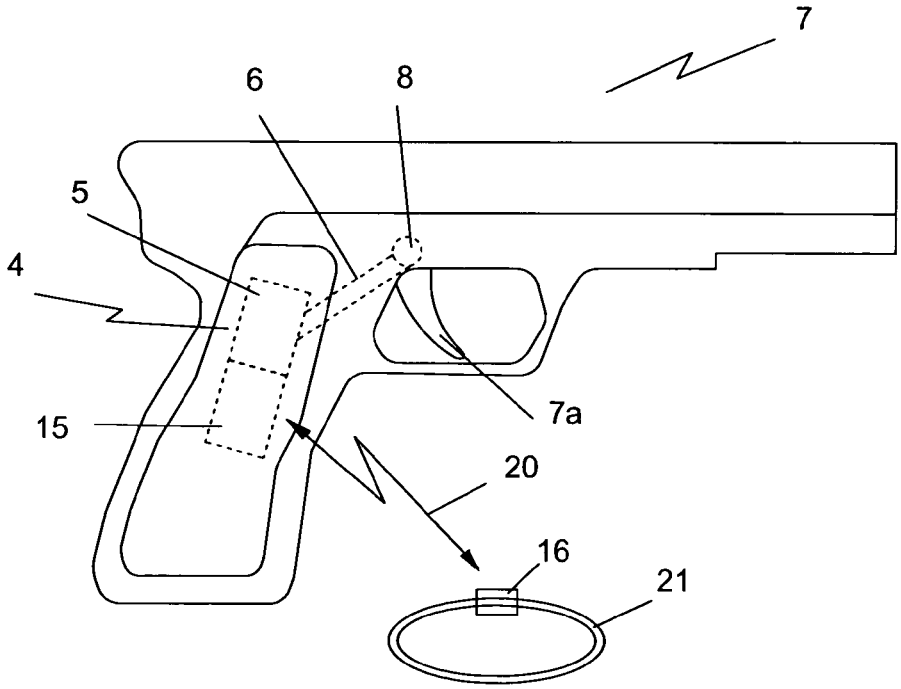
FIG. 4 is a schematic illustration of a further safety feature of the system of the invention.

As shown in FIG. 4, in a preferred arrangement of the system of the invention, the safety device 4 further comprises a reader device 15 coupled with the actuating circuit 6 of the safety device 4 and a tag device 16 adapted to be worn by a user of a firearm 7. Each of the reader device 15 and the tag device 16 comprises a transmitter-receiver (not shown) and are adapted to exchange and process wireless authorisation signals 20 within a predetermined distance range from each other. Accordingly, when a firearm 7 equipped with the safety device 4 having the reader device 15 is located within the predetermined distance range from the tag device 16, the reader device 15 and the tag device 16 exchange and process the wireless authorisation signal 20, whereby the reader device 15 prompts the actuating circuit 6 to release the locking mechanism 8 from the locking mode and to enable the firearm 7.

As soon as the safety device 4 and the tag device 16 are separated by a distance greater than the predetermined distance, the reader device 15 prompts the actuating circuit 6 to actuate the locking mechanism 8 which causes the locking mechanism 8 to assume a locking mode and to disable the firearm 7. The predetermined distance range within which the reader device 15 and the tag device 16 can exchange and process the authorisation signal 20 is between 0 m and 1 m. Thus, the system of the invention further restricts the usability of a firearm 7 when the authorised user of the firearm 7 is outside the designated area 10, i.e. outside the predetermined distance of operability of the command signal 9 of the transmitter and/or receiver 2 of the base unit 1. Accordingly, the firearm 7 can only be used by the authorised user, i.e. a wearer of the tag device 16 and within an area in the immediate vicinity of an authorised user wearing the tag device 16.

The transmitter and/or receiver 5 of the safety device 4 is coupled with the actuating circuit 6 so that it overrides the reader device 15 in controlling the actuating circuit 6. Accordingly, when a firearm 7 equipped with the safety device 4 is within the designated area 10, i.e. within the predetermined distance of operability of the command signal 9, the transmitter and/or receiver 2 of the base unit 1 and the transmitter and/or receiver 5 of the safety device 4 exchange and process the command signal 9 so that the transmitter and/or receiver 5 of the safety device 4 prompts the actuating circuit 6 to actuate the locking mechanism 8 thereby causing the locking mechanism 8 to assume the locking mode and disable the firearm 7 regardless whether or not the safety device 4 is located within the predetermined distance range from the tag device 16 and whether or not the reader device 15 has prompted the actuating circuit 6 to release the locking mechanism 8. Due to this arrangement, when an authorised wearer of the tag device 16 who carries an enabled firearm 7 equipped with the safety device 4 enters the designated area 10, the transmitter and/or receiver 2 of the safety device 4 overrides the command of the reader device 15 and prompts the actuating circuit 6 to actuate the locking mechanism 8 into the locking mode thereby disabling the firearm.

The predetermined distance range of operability of the command signal 9 exchanged between the transmitter and/or receiver (2, 5) of the safety device 4 and the base unit 1 is considerably (e.g. tens of times) greater than the predetermined distance range of the authorisation signal 20 exchanged between the reader device 15 and the tag device 16. More specifically, the predetermined distance range of operability of the command signal 9 is comparable with dimensions of a building 12 (e.g. about 100 m), whereas the predetermined distance range of operability of the authorisation signal 20 lies within an immediate vicinity of a user wearing the tag device 16 and is preferably between 0 m to 1 m.

The wireless communication between the transmitter and/or receiver 2 of the base unit 1 and the transmitter and/or receiver 5 of the safety device 4 is preferably a radio-frequency (RF) communication which is carried out using a local area wireless communication protocol capable of operating within a distance of 0 m to 100 m and preferably within 0 m to 200 m, or within 0 m to 1000 m, the distance being adjustable to a desired smaller distance if required. The local area wireless communication protocol is preferably a low-data protocol the use of which renders the wireless connection between the transmitter and/or receiver 2 of the base unit 1 and the transmitter and/or receiver 5 of the safety device 4 a low-power connection. Preferably, the radio-frequency is selected from the ultra-high RF band (300 MHz to 3 GHz).

The wireless communication between the transmitter-receiver of the reader device 15 and the transmitter-receiver of the tag device 16 is preferably a radio-frequency (RF) communication which is carried out using a short-range wireless transmission protocol capable of operating within a distance of 0 m to 1 m. Preferably, the radio-frequency is selected from the high RF band (3 MHz to 30 MHz). One of the reader device 15 and the tag device 16 is preferably battery operated and the other is a passive device so as to render the wireless connection between the reader device 15 and the tag device 16 a low-power connection.

The tag device 16 can be mounted on a bracelet 21 or be provided in any other convenient form, e.g. a ring, a cuff link, a wristwatch, etc.

The signals (9, 20) exchanged between the reader device 15 and the tag device 16 and between the transmitter and/or receiver 2 of the base unit 1 and the transmitter and/or receiver 5 of the safety device 4 can be either coded or un-coded. Preferably, the authorisation signals 20 exchanged between the reader device 16 and the tag device 15 are coded so that a firearm 7 equipped with a specific safety device 4 of the present invention can only be enabled by a matching tag device 16, or a group of matching tag devices 16 sharing the same code.

The locking mechanism 8 is preferably arranged to remain in the locking mode at all times without the need for the actuating circuit 6 to keep it in the locked mode, so that the actuating circuit 6 is only needed to switch the locking mechanism 8 between the locked and the released modes, thereby minimising the power required for manipulating the locking mechanism 8. Although not shown in the drawings, the actuating circuit 6 may comprise an electro-mechanical element, such as, for example, a solenoid or an electromagnetic actuator for actuating the locking mechanism 8. Once the locking mechanism 8 is in the locked mode, it can only be released by the actuating circuit 6. Although not illustrated, the locking mechanism 8 can comprise a pin or a catch member moveable under the influence of the actuating circuit 6 in and out of locking engagement with the trigger 7*a* so as to respectively lock and unlock the trigger 7*a*.

As a further safety feature, one of the tag device 16 or the reader device 15 can comprise a manual on/off switch (not shown) so that the tag and the reader devices can exchange the authorisation signal 20 within the pre-determined distance range only upon actuation of the switch by the authorised user.

It will be appreciated by those skilled in the art that variations and modifications can be made without departing from the scope of the invention as defined in the appended claims.

The invention claimed is:

1. A firearm enabling and disabling electronic system comprising at least one base unit comprising a transmitter and/or receiver; and at least one safety device comprising a transmitter and/or receiver adapted to exchange and process wireless command signals with the transmitter and/or receiver of the base unit;

an actuating circuit controlled by the transmitter and/or receiver of the safety device and adapted to actuate a locking mechanism, the locking mechanism being operable to prevent a firearm from firing;

wherein the wireless command signal is operable within a first predetermined distance range between the base unit and the safety device;

wherein the safety device further comprises a reader device coupled with the actuating circuit of the safety device and a tag device adapted to be worn by a user of a firearm, wherein each of the reader device and the tag device comprises a transmitter-receiver, wherein the reader device and the tag device are adapted to exchange and process wireless authorisation signals within a second predetermined distance range from each other, wherein when the safety device is located within the second predetermined distance range from the tag device, the reader device and the tag device exchange and process the wireless authorisation signal, whereby the reader device prompts the actuating circuit to release the locking mechanism from the locking mode;

wherein the reader device and the tag device are mutually configured so that once the safety device and the tag device are separated by a distance greater than the second predetermined distance range, the reader device prompts the actuating circuit to actuate the locking mechanism thereby causing the locking mechanism to assume a locking mode capable of preventing a firearm equipped with the safety device from firing;

wherein when the safety device is located within the predetermined distance from the base unit, transmitters and/or receivers of the base unit and of the safety device exchange the wireless command signal which causes the transmitter and/or receiver of the safety device to prompt the actuating circuit to actuate the locking mechanism thereby causing the locking mechanism to assume a locking mode capable of preventing a firearm from firing;

wherein the first predetermined distance range between the base unit and the safety device within which the wireless command signal is operable and within which the transmitter and/or receiver of the base unit and the transmitter and/or receiver of the safety device can exchange and process the wireless command signal is sufficient to cover a designated area in which firearms equipped with the safety device of the system need to be disabled;

wherein the base unit is disposed within the designated area;

wherein the transmitter and/or receiver of the safety device is coupled with the actuating circuit to override the reader device in controlling the actuating circuit, whereby when the safety device is within the first predetermined distance range of operability of the wireless command signal, the transmitter and/or receiver of the base unit and the transmitter and/or receiver of the safety device exchange and process the wireless command signal, whereby the transmitter and/or receiver of the safety device prompts the actuating circuit to actuate the locking mechanism thereby causing the locking mechanism to assume the locking mode regardless whether or not the safety device is located within the second predetermined distance range from the tag device and whether or not the reader device has prompted the actuating circuit to release the locking mechanism; and wherein the first predetermined distance range of operability of the wireless command signal exchanged between the transmitter and/or receiver of the safety device and the base unit is greater than the second predetermined distance range of operability of the wireless authorisation signal exchanged between the reader device and the tag device.

2. The system as claimed in claim 1, wherein the first pre-determined distance is between 0 m and 100 m.

3. The system as claimed in claim 1, wherein the first pre-determined distance is between 0 m and 200 m.

4. The system as claimed in claim 1, wherein the safety device is incorporated into a firearm and wherein the locking mechanism co-operates with a firing mechanism of the firearm.

5. The system as claimed in claim 1, wherein the system comprises a plurality of safety devices for incorporating into a plurality of firearms.

6. The system as claimed in claim 5, wherein the same wireless command signal is processable by each safety device.

7. The system as claimed in claim 5, wherein the base unit is adapted to process a plurality of wireless command signals each wireless command signal being unique to one corresponding safety device.

8. The system as claimed in claim 1, wherein the second predetermined distance range is between 0 m and 1 m.

9. The system as claimed in claim 1, wherein the first predetermined distance range of operability of the wireless command signal is comparable with dimensions of a building (from about 10 m to about 100 m), whereas the predetermined distance range of operability of the wireless authorisation signal lies within an immediate vicinity of a user wearing the tag device and is between 0 m to 1 m.

10. The system as claimed in claim 1, wherein the wireless communication between the transmitter and/or receiver of the base unit and the transmitter and/or receiver of the safety device is a radio-frequency (RF) communication which is carried out using a local area wireless communication protocol.

11. The system as claimed in claim 10, wherein the wireless communication between the transmitter and/or receiver of the base unit and the transmitter and/or receiver of the safety device is capable of operating within a distance of 0 m to 100 m.

12. The system as claimed in claim 10, wherein the wireless communication between the transmitter and/or receiver of the base unit and the transmitter and/or receiver of the safety device is capable of operating within a distance of 0 m to 200 m.

13. The system as claimed in claim 10, wherein the wireless communication between the transmitter and/or receiver of the base unit and the transmitter and/or receiver of the safety device is capable of operating within a distance of 0 m to 1000 m.

14. The system as claimed in claim 10, wherein the distance is adjustable to a desired smaller distance if required.

15. The system as claimed in claim 10, wherein the local area wireless communication protocol is a low-data protocol the use of which renders the wireless connection between the transmitter and/or receiver of the base unit and the transmitter and/or receiver of the safety device a low-power connection.

16. The system as claimed in claim 10, wherein the radio-frequency is selected from the ultra-high RF band (300 MHz to 3 GHz).

17. The system as claimed in claim 1, wherein the wireless communication between the transmitter-receiver of the reader device and the transmitter-receiver of the tag device is a radio-frequency (RF) communication which is carried out using a short-range wireless transmission protocol capable of operating within a distance of 0 m to 1 m.

18. The system as claimed in claim 17, wherein the radio-frequency is selected from the high RF band (3 MHz to 30 MHz).

19. The system as claimed in claim 18, wherein one of the reader device and the tag device is battery operated and the other is a passive device to render the wireless connection between the reader device and the tag device a low-power connection.

20. The system as claimed in claim 18, wherein the tag device is incorporated into one of a ring, a bracelet, a wristwatch or a cuff link.

21. The system as claimed in claim 18, wherein, the wireless authorisation signals exchanged between the reader device and the tag device are coded so that a firearm equipped with a safety device of the present invention can only be enabled by a matching tag device, or a group of tag devices sharing the same code.

22. The system as claimed in claim 18, wherein the locking mechanism is configured to remain in the locking mode at all times without the need for the actuating circuit to keep it in the locked mode.

23. The system as claimed in claim 18, wherein the locking mechanism is configured to retain itself in the locked mode or in the released mode wherein the actuating circuit is only required to switch the locking mechanism between the locked and the released modes.

24. The system as claimed in claim 18, wherein the actuating circuit comprises an electro-mechanical element for actuating the locking mechanism.

25. The system as claimed in claim 24, wherein the actuating circuit comprises a solenoid.

26. The system as claimed in claim 24, wherein the actuating circuit comprises an electromagnetic actuator.

27. The system as claimed in claim 18, wherein the locking mechanism and the actuating circuit are configured so that once the locking mechanism is in the locked mode, it can only be released by the actuating circuit.

28. The system as claimed in claim 18, wherein the locking mechanism comprises a pin or a catch member moveable under the influence of the actuating circuit in and out of locking engagement with a firing mechanism of a firearm.

29. The system as claimed in claim 18, wherein one of the tag device or the reader device comprises a manual on/off switch so that the tag and the reader can exchange the wireless authorisation signal within the second pre-determined distance range upon actuation of the switch by the authorised user.

30. The system as claimed in claim 1, wherein one of the reader device and the tag device is battery operated and the other is a passive device to render the wireless connection between the reader device and the tag device a low-power connection.

31. The system as claimed in claim 1, wherein the tag device is incorporated into one of a ring, a bracelet, a wristwatch or a cuff link.

32. The system as claimed in claim 1, wherein, the wireless authorisation signals exchanged between the reader device and the tag device are coded so that a firearm equipped with a safety device of the present invention can only be enabled by a matching tag device, or a group of tag devices sharing the same code.

33. The system as claimed in claim 1, wherein the locking mechanism is configured to remain in the locking mode at all times without the need for the actuating circuit to keep it in the locked mode.

34. The system as claimed in claim 1, wherein the locking mechanism is configured to retain itself in the locked mode or in the released mode wherein the actuating circuit is only required to switch the locking mechanism between the locked and the released modes.

35. The system as claimed in claim 1, wherein the actuating circuit comprises an electro-mechanical element for actuating the locking mechanism.

36. The system as claimed in claim 35, wherein the actuating circuit comprises a solenoid.

37. The system as claimed in claim 35, wherein the actuating circuit comprises an electromagnetic actuator.

38. The system as claimed in claim 1, wherein the locking mechanism and the actuating circuit are configured so that once the locking mechanism is in the locked mode, it can only be released by the actuating circuit.

39. The system as claimed in claim 1, wherein the locking mechanism comprises a pin or a catch member moveable under the influence of the actuating circuit in and out of locking engagement with a firing mechanism of a firearm.

40. The system as claimed in claim 1, wherein one of the tag device or the reader device comprises a manual on/off switch so that the tag and the reader can exchange the wireless authorisation signal within the second pre-determined distance range upon actuation of the switch by the authorised user.

* * * * *